United States Patent [19]

Martenson

[11] 4,263,889

[45] Apr. 28, 1981

[54] COMBINATION FIREPLACE FURNACE AND COOKSTOVE

[76] Inventor: Donald S. Martenson, 24430 S. Highway 99E, Canby, Oreg. 97013

[21] Appl. No.: 973,875

[22] Filed: Dec. 28, 1978

Related U.S. Application Data

[63] Continuation-in-part of Ser. No. 843,986, Oct. 20, 1977, Pat. No. 4,166,444.

[51] Int. Cl.[3] ..... F24B 7/00; F24B 1/26

[52] U.S. Cl. ..... 126/123; 126/137; 126/6; 126/121

[58] Field of Search ..... 126/137, 123, 121, 126, 126/136, 4, 63, 67, 6, 336, 100, 58

[56] References Cited

U.S. PATENT DOCUMENTS

| | | | |
|---|---|---|---|
| 797,630 | 8/1905 | Stowe | 126/137 |
| 831,096 | 9/1906 | Posey | 126/137 |
| 1,255,493 | 2/1918 | Williams | 126/120 |
| 1,370,349 | 3/1921 | Nichols | 126/137 |
| 2,161,723 | 6/1933 | Rutland . | |
| 2,642,859 | 6/1953 | Brown . | |
| 2,703,567 | 3/1955 | Manchester et al. . | |
| 2,743,720 | 5/1956 | Dollinger | 126/121 |
| 4,015,581 | 4/1977 | Martenson | 126/121 |
| 4,166,444 | 9/1979 | Martenson | 126/120 |
| 4,178,908 | 12/1979 | Trexler, Sr. | 126/121 |

*Primary Examiner*—James C. Yeung
*Assistant Examiner*—Larry Jones

[57] ABSTRACT

A combination fireplace furnace and cookstove is adapted for insertion as a unit into the front opening of an existing fireplace. Such apparatus includes a firebox portion adapted for positioning within a fireplace and a cookstove portion provided with a cooktop, designed to protrude into the room when the apparatus is installed in a fireplace. A sheet metal jacket around the firebox portion encloses an airspace communicating with air intakes at the front of the unit. Heat exchange tubes communicating with the airspace at the back of the firebox pass through the firebox and cookstove portions to discharge openings at the front of the unit so that air warmed in the airspace is further heated in such tubes before discharge into the room. A baffle within the firebox directs products of combustion forwardly into the cookstove portion to heat the cooktop and upper heat exchange tubes before passing up the chimney. The baffle includes a damper movable between an open position to allow combustion products to rise directly up the chimney and a closed position to heat the cooktop. The cookstove portion has a front opening closed by one of a group of interchangeable doors.

13 Claims, 6 Drawing Figures

FIG.4
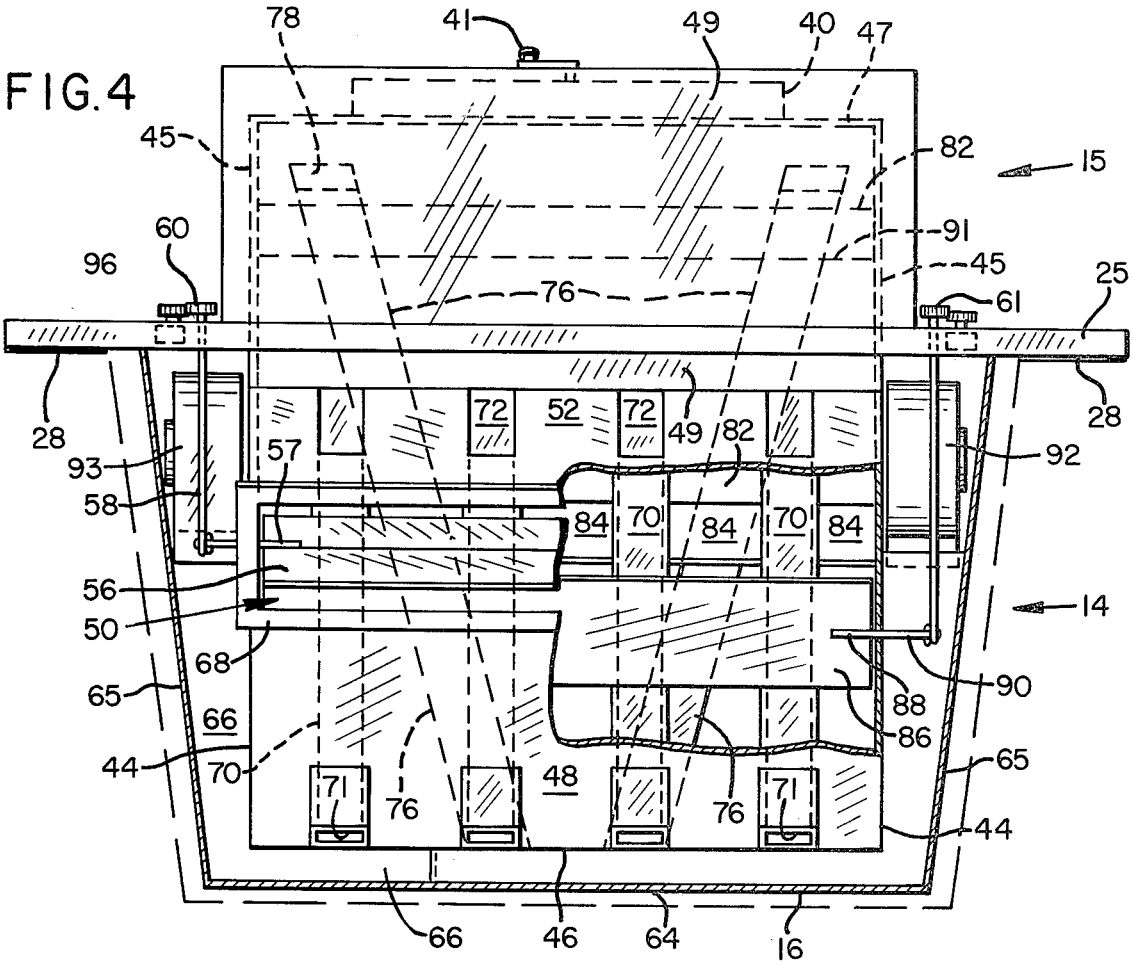
FIG.5
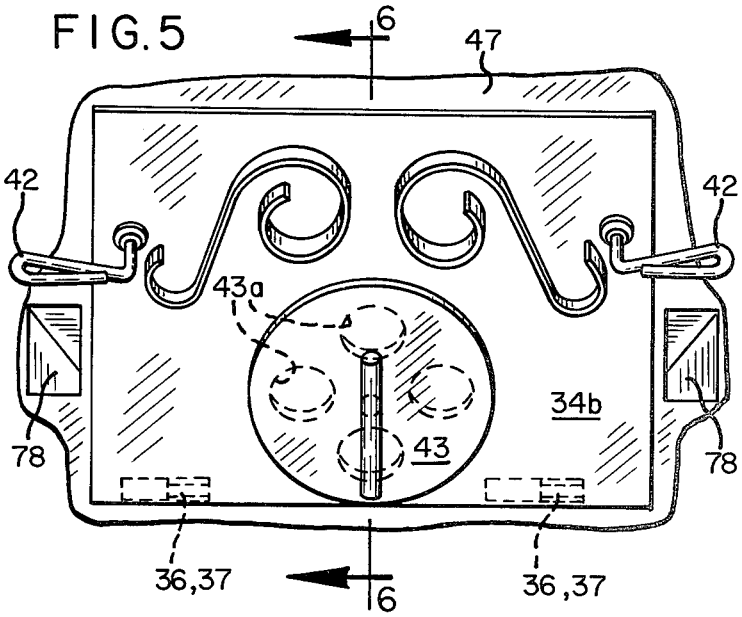
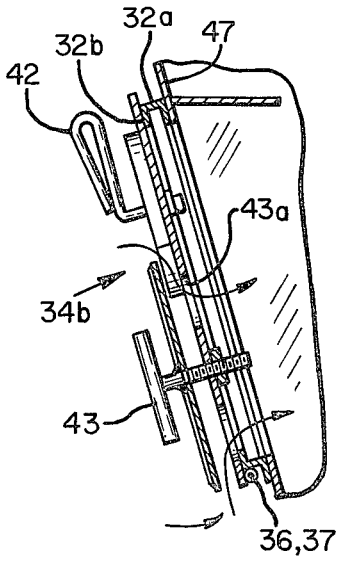
FIG.6

COMBINATION FIREPLACE FURNACE AND COOKSTOVE

CROSS REFERENCES TO RELATED APPLICATIONS

This is a continuation-in-part of my copending application for patent for Fireplace Furnace with Heat Exchange Tubes, Ser. No. 843,986, filed Oct. 20, 1977, now U.S. Pat. No. 4,166,444.

BACKGROUND OF THE INVENTION

1. Field of the Invention

The present invention relates generally to fireplace furnaces adapted for insertion within existing conventional fireplaces and more particularly to a combination fireplace furnace and cookstove.

2. Description of the Prior Art

Conventional fireplaces are notoriously inefficient room heaters because they draw warm room air into the fireplace and up the chimney when used. This problem can be solved by use of doors on the fireplace, but their use substantially reduces the radiation of heat from a fire in the fireplace into the room.

To improve the efficiency of such fireplaces, several approaches have been taken. Fireplace furnaces of the "heatalator" type are well known, in which the fireplace itself is built with special heat outlet openings in the front wall of the fireplace above or alongside the fireplace opening so that air can be circulated along side and rear heat exchanging surfaces of the firebox and heated for discharge into the room through such openings. However, these designs all require either rebuilding or modification of an existing fireplace or installation of the furnace during the original construction of the fireplace.

To provide a more efficient fireplace furnace, I designed a self-contained prefabricated fireplace furnace for insertion within a conventional fireplace, shown in my U.S. Pat. No. 4,015,581, issued Apr. 5, 1977. The heater unit includes a metal firebox within a surrounding metal jacket. Room air is drawn into side inlet openings at the front of the jacket, warmed by the firebox walls serving as heat exchange surfaces, and then expelled back into the room through an upper portion of the jacket, all by natural convection. Although this heater is satisfactory to maintain warm temperatures in a room, it requires a considerable length of time to heat a cold room because of the low rate of air movement through the heater.

Use of fans to provide forced air circulation through fireplace heaters has been previously proposed in U.S. Pat. Nos. 2,642,859 and 2,743,720. However, use of such fans does not entirely solve the problem because of their tendency to move air though the heater and back into the room before the air could be adequately warmed because of the limited heat exchange surface area in the heater.

I therefore devised a further improved fireplace furnace as disclosed in my U.S. Pat. No. 4,166,444. Such furnace has a jacketed firebox with heat exchange tubes extending through the firebox from the airspace at the rear of the firebox to discharge openings at the front of the firebox. This design enables efficient use of the heat produced by a fire by circulating room air first through the side and rear airspace and then through the heat exchange tubes, thereby exposing such air to progressively hotter portions of the firebox chamber.

Although my foregoing improved design provides optimum efficiency in a fireplace furnace, it and all other known fireplace furnaces have two disadvantages when compared to conventional free-standing woodstoves, namely, (1) they cannot be used for cooking, and (2) they do not radiate heat as effectively as a woodstove.

Therefore, a primary object of the present invention is to provide a fireplace furnace having all of the advantages of my prior fireplace furnaces, and, in addition, the advantages of a woodstove; namely, the ability to cook and radiate heat effectively.

Another primary object of the present invention is to provide a combination fireplace furnace and cookstove adapted for insertion as a unit into the front opening of an existing fireplace.

SUMMARY OF THE INVENTION

The present invention is an improvement of the fireplace furnaces disclosed in my prior U.S. Pat. Nos. 4,015,581, and 4,166,444.

It employs a firebox portion adapted for positioning within a fireplace, and an integral cookstove portion which protrudes forwardly from the front opening of a fireplace into a room when the firebox portion is positioned within the fireplace. The cookstove portion includes a cooking surface, and an access opening with a door for enclosing the fire chamber. The access opening and door can be positioned either at the front wall or a side wall of the cookstove portion. The access door to the cookstove portion is designed to be interchangeable among a variety of doors.

A baffle means is provided within the chamber for directing products of combustion forwardly from the firebox chamber toward the cookstove chamber for heating the cookstove portion, generally, and the cooking surface, in particular, before such gases escape up the chimney. The baffle means includes a stationary portion within the firebox chamber and extending into the stove chamber and a damper portion within the firebox chamber. The damper is pivotable between open and closed positions for selectably allowing products of combustion from a fire in the firebox chamber either to rise directly to flue means for exhaustion from the firebox thereby allowing the cookstove portion to remain relatively cool, or to be directed forwardly into the stove chamber. The baffle means can also include a second stationary portion spaced below the first portion but above the access door, extending from the front wall into the cookstove chamber. The invention also features an airspace between the firebox walls and the walls of the fireplace having frontal openings for alowing ambient room air to circulate into contact with the outer surfaces of the firebox walls for heating. A barrier between the airspace and the fireplace chimney prevents room air from escaping up the chimney. A jacket surrounding and integral with said firebox portion, having frontal openings, and spaced apart from the firebox walls can also be employed to enclose the airspace.

The invention can further include multiple heat exchange tubes which extend through the firebox chamber from the airspace at the rear of the apparatus for improving the heating efficiency of the apparatus. Such tubes can include a row of upper tubes extending through an upper portion of the firebox chamber to discharge heated air above the cooking surface of the cookstove portion. Within the firebox chamber such upper tubes are integrated with the baffle means and damper so as to cooperate both in heating the air contained within such tubes and in directing products of combustion forwardly into the cookstove chamber. Lower tubes can extend from the airspace through both the firebox and cookstove chambers to discharge openings on each side of the access opening at the front of the cookstove portion. The lower tubes are positioned to support combustible materials and to contact the hot ashes and coals of a fire. They are positioned at an incline downward from the front access opening so that combustible materials, such as logs, placed thereon are easily moved to the firebox chamber.

Baffle means can be employed within the airspace on the sides and rear of the firebox portion for directing air flow along the sides and back of the firebox and to particular heat exchange tubes. In addition, air blowers can be provided near the front openings of the air space for forcing additional air through the airspace and tubes, thereby augmenting the natural convection of such air.

The foregoing and other objects, advantages and features of my invention will become more apparent from the following description which proceeds with reference to the accompanying drawings.

BRIEF DESCRIPTION OF THE DRAWINGS

In the drawings:

FIG. 4 is a top plan view of the apparatus of FIGS. 1–3 with top portions of the jacket removed and part of the firebox upper wall removed to expose the dampers, inner baffles and heat exchange tubes.

FIG. 5 is an enlarged partial front elevational view of the apparatus of FIG. 1 showing a solid, adjustable-draft door in lieu of the glass, edge-draft door of FIG. 1.

FIG. 6 is a vertical section view of the structure of FIG. 5 taken along line 6—6.

DESCRIPTION OF THE PREFERRED EMBODIMENT

Figure 1:
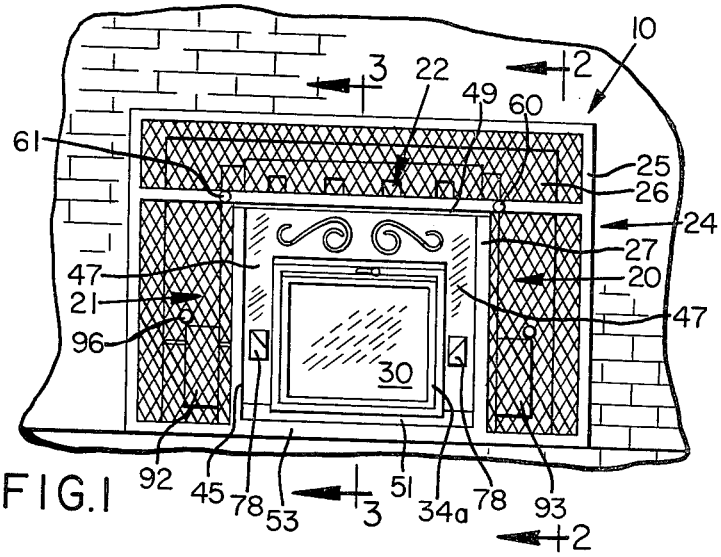
FIG. 1 is a front elevational view of a combination fireplace furnace and cookstove according to my invention shown positioned in the front opening of an existing fireplace.
Figure 2:
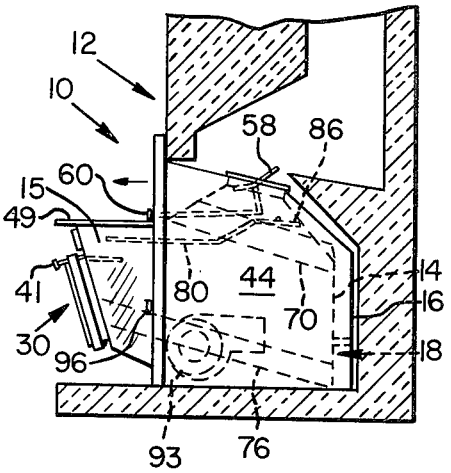
FIG. 2 is a vertical sectional view through a typical fireplace taken along line 2—2 of FIG. 1, and showing the apparatus of my invention installed in the fireplace.
Figure 3:
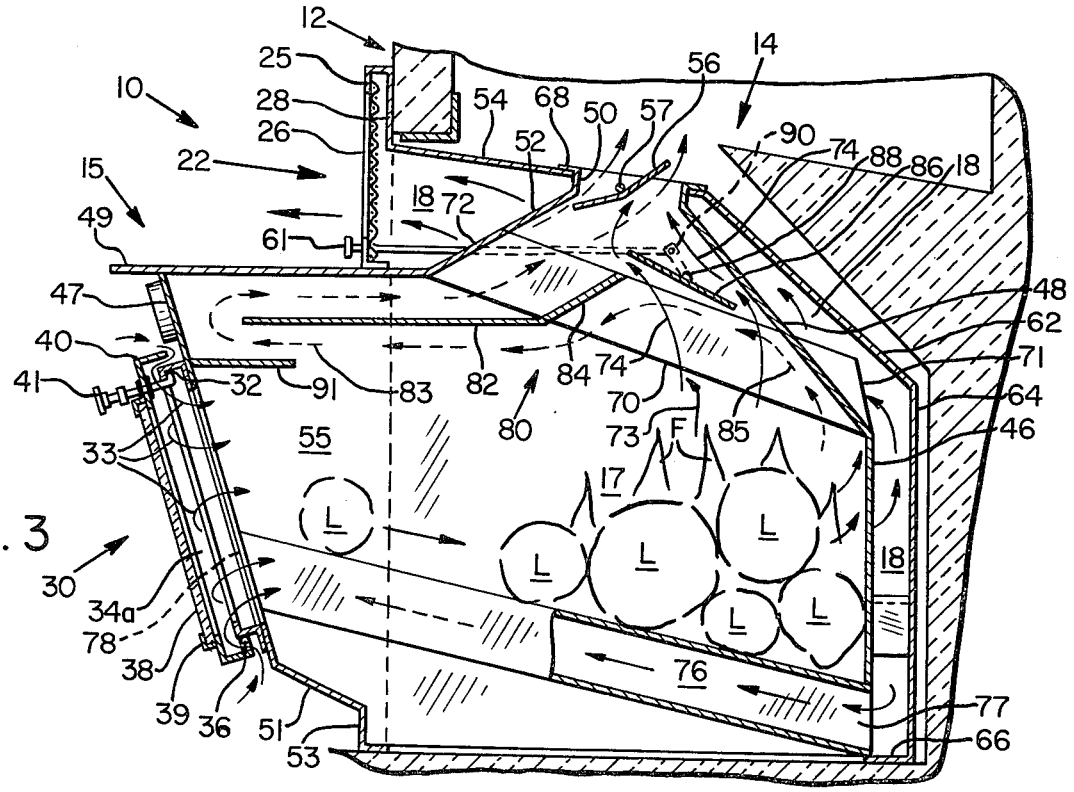
FIG. 3 is a vertical sectional view of the fireplace and apparatus of FIG. 1 taken along line 3—3.

Referring to the drawings, FIGS. 1–3 disclose a combination fireplace furnace and cookstove apparatus 10 inserted somewhat like a drawer into the opening of a fireplace 12. The apparatus 10 includes a firebox portion 14 positioned within fireplace 12 and a cookstove portion 15 protruding forwardly from the fireplace. Both portions 14 and 15 are preferably made of heavy gauge steel. The opposite sides, back and top walls of the firebox portion 14 surround a firebox chamber 17. Firebox portion 14 is, in turn, surrounded by a sheet metal jacket 16. The walls of the jacket are spaced from the walls of the firebox portion to define an airspace 18 therebetween through which room air is circulated.

The front of the jacket 16 is open and substantially flush with the front wall of the fireplace 12. The open front of the jacket defines front room air inlet openings 20, 21 at opposite sides of the cookstove portion 15 into the airspace within the jacket. The open front of the jacket above the upper wall portions of the firebox portion defines a warm air outlet opening 22 through which warm air from the furnace is discharged back into the room.

The front openings of the jacket are covered with a grille front 24 including a rigid grille frame 25 and grille screen 26 supported by the frame. The grille front extends from a flange 27 defining an inner margin surrounding the firebox portion to outer margins terminating outwardly beyond the outer margins of the fireplace front opening. Those portions of the grille front extending beyond the outer margins of the jacket 16 are backed by sheets of air-impervious backing material 28, such as asbestos or sheet metal, as shown in FIGS. 3 and 4, to prevent room air from entering the fireplace opening around the furnace and flowing up the fireplace chimney. Thus, when the furnace is installed in a fireplace, room air is forced to enter either the apparatus itself as draft air for the fire, or the jacket for heating and recirculation into the room.

The firebox portion has vertical opposite sidewalls 44 (FIG. 4) meeting a vertical backwall 46. The upper wall of the firebox portion includes a rear upper wall portion 48 pitched downwardly and rearwardly from a top exhaust opening or flue 50 and a front upper wall portion 52 pitches downwardly and forwardly from exhaust opening 50. Exhaust opening 50 extends through a top wall 54 of jacket 16 to allow for the escape of hot gases and smoke from the apparatus into the fireplace chimney. Exhaust opening 50 extends substantially the full width of the firebox portion as shown in FIG. 4. A damper plate 56 mounted on a shaft 57 within exhaust opening 50 is operated by a lever and rod type actuating linkage means 58 shown in FIG. 2. The linkage terminates at a knob 60 at the grille front 24 for adjusting the degree of closure of exhaust opening 50.

The bottom of the firebox portion is open as shown in FIG. 4 of my U.S. Pat. No. 4,166,444, thereby enabling the use of the fireplace floor on which to build a fire or to collect ashes. This feature also prevents the possibility of burning out a bottom wall of the firebox portion.

Jacket 16 includes the slightly rearwardly and downwardly sloping forward top wall portion 54 and a more steeply pitched rear top wall portion 62. A generally vertical rear wall 64 joins the rear top wall portion and generally vertical opposite sidewalls 65. The jacket sidewalls slope rearwardly and inwardly to conform to the usual shape of the sidewalls of a fireplace. Although the bottom of the firebox is open as previously mentioned, the bottom of the jacket is closed by a bottom wall 66, which connects the firebox to the jacket so that they are unitary. The firebox and jacket are also interconnected at flanged portions 68 surrounding the firebox exhaust opening 50.

The cookstove portion 15 has vertical opposite sidewalls 45 which are a forward continuation of firebox sidewalls 44. Sidewalls 45 meet a front wall 47, a top-wall 49 providing a cooking surface or cooktop, and bottom wall portions 51 and 53 to enclose a stove chamber 55 which is a forward continuation of firebox chamber 17. Cooktop 49 is a heavy horizontal rectangular plate which meets the front upper wall 52 rearwardly of the grille front. Cooktop 49 overlaps sidewalls 45 and front wall 47. Bottom wall 53 is a generally vertical wall connected to flange 27 at each end. The bottom edge of wall 53 is adapted for sealing against the fireplace floor and the top edge of wall 53 is connected to wall 51. Wall 51 is inclined upwardly and forwardly at about 60° from vertical and connects to the bottom edge of front wall 47. The ends of wall 51 are connected to lower edges of sidewalls 45.

Front wall 47 is inclined upwardly and forwardly at about 30° from vertical and is connected on opposite edges to the forward edges of sidewalls 45.

A rectangular front access opening 30 is provided through front wall 47 for permitting access to the chambers 17 and 55, for example, for adding fuel to the fire. Around the perimeter of opening 30 is a frame 32 for mounting access door 34. Referring to FIG. 6, the frame comprises a first flange portion 32*a* extending normally outward from wall 47, and a second flange portion 32*b* extending from the first portion 32*a* inwardly toward opening 30 parallel to front wall 47. Two hinge mounts 36 are provided in the lower horizontal member of frame 32 for mounting access door 34. Mounts 36 are hollow cylinders for receiving hinge pins 37 at the bottom of door 34 so that the door can be opened downward (FIG. 5).

The opening frame is designed so that a variety of doors can be used interchangeably on the apparatus. One such door 34*a* is shown in FIG. 1. It has a rectangular transparent tempered glass plate 38 mounted in the door frame by a flange 39 which overlaps the edge of the glass. Door 34*a* includes a flange 40 which partially overlaps frame 32 and is spaced therefrom when the door is mounted so that room air can enter the firebox through the resulting gap about the periphery of the door, as shown by arrows 33 in FIG. 3. This design simultaneously provides draft air to the fire chamber and an air barrier over the inside of the glass to protect it from heat and smoke. A simple rotating latch 41 latches the door by rotating a radial member beneath a flange 32*b* of the access opening frame.

Referring to FIGS. 5 and 6 a second steel door 34*b* is interchangeable with glass door 34*a*. Door 34*b* fits tightly against frame 32 when mounted on hinges 36, 37 to provide airtight closure of the access opening. Two simple rotating latches 42 latch door 34*b* by rotating radial members beneath flanges 32*b* of the access opening frame. A manually adjustable draft mechanism 43, or a thermostatically controlled draft mechanism (not shown), is positioned below the center or door 34*b* to admit air into the stove chamber through circular apertures 43*a* in the door. Mechanism 43 includes a circular plate, sized to overlap apertures 43*a*, mounted at its center on a threaded shaft. The threaded end of the shaft is received by a threaded bolt-like hole in the door and the opposite end of the shaft has a T-shaped handle for turning the mechanism. The draft of air through the apertures is adjusted by screwing the mechanism outward from the door to admit more air or inward for less air.

A row of upper heat exchange tubes 70 extend through an upper portion of the firebox chamber. Each tube 70 has an air intake opening 71 communicating with the airspace within the back of jacket 16 and a front discharge opening 72 opening into a jacket airspace 22 above the rear edge of cooktop 49.

The upper heat exchange tubes 70 pass through the firebox chamber at an inclination from back to front thereof and are of rectangular cross-section with a flat bottom surface facing downwardly toward the fire F within the firebox. Thus hot smoke and gases from fire F heat the tubes 70 and flow upwardly and forwardly along such tubes, as shown by arrows 73 in FIG. 3, before passing about such tubes and out through exhaust opening 50 into the fireplace flue, as shown by arrows 74. In the embodiment shown, there are four upper tubes spaced apart horizontally across the upper portion of the firebox chamber through substantially its entire width, although any number of such tubes could be provided, including, if desired, other rows of tubes above or below the row of tubes 70. Tubes 70, heated directly by hot gases and smoke from fire F, heat air entering through inlets 71 from the airspace at the back of the firebox. The heated air passes from tube outlets 72 into jacket air outlet 22, through grille screen 26 and returns to the room in which the fireplace is situated.

A second, lower pair of heat exchange tubes 76 extends through the bottom of the firebox and stove chambers at an inclination upwardly from back to front. Such lower tubes include intake openings 77 in communication with the airspace behind backwall 46 and discharge openings 78 (FIG. 1) passing through the front wall 47 of the cookstove portion, one opening of each side of the access opening 30. The pair of lower tubes 76 are of rectangular cross-section, are sufficiently close together to support logs L, and generally diverge from rear to front (FIG. 4).

A baffle 80 extends between opposite sidewalls 44, 45 across an upper part of the firebox and stove chambers 17, 55 for directing rising hot smoke and gases from fire F forwardly toward the front of the cookstove portion. Baffle 80 includes a horizontal forward portion 82, inclined intermediate portions 84 and a pivoted damper portion 86.

Horizontal portion 82 is spaced below the cooktop 49, and has a front edge spaced from front wall 47 to provide, together with the cooktop, a pathway 83 for smoke and gases which pass in contact with the cooktop, front wall and upper portions of sidewalls 45.

Intermediate baffle portions 84 are gently inclined continuations of forward portion 82 which extend between tubes 70 and sidewalls 44 to seal off these areas from the upward passage of smoke and combustion gases.

Damper portion 86 is positioned above tubes 70 and rearwardly of intermediate baffle portions 84, and extends horizontally between sidewalls 44. It comprises a plate affixed to a shaft 88. The shaft is loosely fitted into holes in sidewalls 44 so that the damper can be pivoted between an open position (FIG. 3) and a closed position (shown in phantom lines in FIG. 2). The plate is sized so that, when closed, its front edge meets the rear edges of baffles 84 and adjacent surfaces of tubes 70, while the rear edge of the plate contacts rear upper wall 48. Thus, the damper forms a complete barrier to rising smoke and hot gases when closed.

Closure of damper 86 is effected by lever and rod type actuating linkage means 90 shown in FIGS. 3 and 4. The linkage terminates at a knob 61 at the grille front 24 for manually adjusting the degree of closure of damper 86.

A second horizontal baffle 91 extends between opposite sidewalls 45 in stove chamber 55. It is positioned below baffle 80 but above access opening 30. Baffle 91 thereby serves to deflect draft air, which enters around the edge of glass door 34*a*, downward and separate it from the flow of smoke indicated by arrow 83 in FIG. 3.

A pair of electric motor operated air blowers 92, 93 are mounted in front openings of airspace 18, one on each side of the firebox. They are operated by a control knob 96 to blow ambient room air rearwardly into the airspace.

A system of baffles within the airspace directs incoming air to selected heat exchange surfaces and tubes. The arrangement and operation of such airspace baffles, blowers and tubes are described in two different embodiments in my U.S. Pat. No. 4,166,444, and therefore need not be further discussed herein.

Several variations may be employed within the spirit of the present invention. For example, simplified versions of the above-described apparatus can be used which omit the upper or lower tubes, or all of them. Similarly, jacket 16 could be omitted so that the side and rear walls of the fireplace form the outer boundary of airspace 18. If this arrangement is employed, a barrier must be provided for preventing air within the airspace from escaping up the chimney. This approach is particularly useful if the existing fireplace is too small to accommodate the additional space requirements of a jacket.

Cooktop 49 is described above as overlapping side and front walls 45, 47. However, if less cooking surface is needed, or if safety reasons require it, the overlapping portions of the cooktop may be eliminated. Similarly, additional cooking surfaces can be provided in the cookstove portion.

Among other variations, the blowers can be omitted without impairing the ability of my apparatus to heat a room by radiation for the cookstove portion and convection of air through the tubes. The access opening can also be positioned on a sidewall 45, rather than on the front wall, so that longer logs can be inserted more easily into the firebox chamber.

OPERATION

The operation of the present invention will be readily apparent from the foregoing description. However, summarizing such operation, a fire is built within firebox chamber with logs L or other material supported on or between the lower heat exchange tubes 76, and door 34 is closed and latched. Damper control handle 60 is adjusted to maintain damper plate 56 in a desired open position so that exhaust gases and smoke can escape upwardly into the fireplace chimney. If steel door **34*b* is employed, draft mechanism 43** is manually adjusted to control the rate of burning of the fire.

With the fire burning satisfactorily, blowers 92, 93 are turned on using control knob 96. The blowers and natural convection cause room air to enter the air space 18 along opposite sides of the firebox portion and circulate through the airspace and tubes, as described in detail in my U.S. Pat. No. 4,166,444. The air is progressively heated by contact with, and radiation from, the heat exchanging surfaces of the firebox walls and tubes before such air is forced out of front tube outlets 78 back into the room.

Initially, damper portion 86 is set in an open position so that smoke and gases flow generally upward around tubes 70 to flue 50. Once the fire is burning satisfactorily and access door 34 is closed, damper control handle 61 is operated to close damper 86 at least partially. This action diverts the flow of smoke and gases toward the cookstove chamber. Consequently, combustion products rise from fire F, and portions of such products move forwardly along the lower surfaces of tubes 70, while the remainder flow around the tubes before moving forwardly in the manner shown by phantom arrow 85 in FIG. 3. Thereupon such products flow as shown by arrow 83 beneath forward baffle portion 82, rise through the opening between the front edge of baffle portion 82 and front wall 47 and then flow backward beneath cooktop 49, causing the cooktop to be heated sufficiently for cooking purposes. The smoke and gases then flow around the discharge ends of upper tubes 70 and out through flue 50.

When it is desired to add additional fuel to the fire, it is preferable to open damper 86 before opening the access door. After doing so the door may be opened without smoke and hot gases escaping into the room. Fuel, such as logs L, can then be placed on the forward upper surfaces of inclined lower tubes 76 and allowed to roll backward into the firebox chamber. Then, after closing the access door, damper 86 is again closed as described above.

The position of damper 86 can be adjusted selectively to any position between its open and closed positions to control the temperature of cooktop 49. Thus, the damper can be opened so that the cookstove portion, including the cooktop, remains relatively cool (for example, to avoid injuries to small unattended children) although hot air is being discharged from the tubes 70, 76 to heat the room. Then, for cooking, or to increase heat radiation into the room, the damper can be partially or completely closed.

Having illustrated and described the principles of my invention from what is presently a preferred embodiment, it should be apparent to those skilled in the art that other modifications can be made without departing from such principles. I claim as my invention all such modifications as come within the true spirit and scope of the following claims.

I claim:

1. A combination fireplace furnace and cookstove apparatus adapted for insertion as a unit into the front opening of an existing fireplace, comprising:

a firebox portion including first wall means defining first heat exchanging surfaces enclosing a firebox chamber; said portion being adapted for positioning within a fireplace with said firebox wall means spaced inwardly of the fireplace walls to define an airspace having frontal air openings for allowing ambient room air to circulate into contact with the outer sufaces of said first wall means, and including means for preventing said room air from escaping up the chimney of the fireplace;

a cookstove portion including second wall means extending forwardly from said first wall means and defining second heat exchange surfaces enclosing a stove chamber forming a forward continuation of said firebox chamber, said cookstove portion being adapted to protrude forwardly into a room from the front fireplace opening when said firebox portion is positioned within the fireplace; and multiple heat exchange tubes for heating air in said tubes, said tubes extending through the firebox chamber from intake openings communicating with said airspace at the rear of said firebox portion to discharge openings at the front of said apparatus for discharging heated air back into the room, at least one of said tubes extending through a lower region of both of said firebox and stove chambers from said airspace to a discharge opening in the front of the cookstove portion.

2. Apparatus according to claim 1 including third wall means providing a jacket surrounding and integral with said firebox portion, said jacket being spaced from said first wall means to enclose said airspace and prevent said room air from escaping from said airspace up the chimney of the fireplace;

said jacket terminating along a forward edge substantially flush with the front of the fireplace opening to form said frontal air openings along opposite lateral sides of said cookstove portion and to leave said second wall means exposed to radiate heat into said room.

3. Apparatus according to claim 1 including air-directing baffle means in said airspace extending generally rearwardly from said frontal side air openings for conducting air to a portion of said airspace about the rear of said firebox portion; and air blower means in said frontal air openings for forcing air rearwardly in said airspace.

4. Apparatus according to claim 1 in which said second wall means includes an upper heat exchanging wall exposed so as to provide the cookstove portion with a cooking surface means for transferring heat from said cookstove chamber to objects placed in contact therewith.

5. Apparatus according to claim 1 including an access opening in a front wall of said second wall means and two lower heat exchange tubes communicating with said airspace at the lower rear of said firebox portion and extending through said firebox chamber and said stove chamber to discharge openings in said front wall opposite lateral sides of the access opening;

said two lower tubes being positioned with their upper surfaces in generally the same plane, at an upward inclination and at mutually divergent angles from rear to front in said apparatus.

6. Apparatus according to claim 1 wherein said second wall means includes an access opening adapted for closure by interchangeable door means; said opening having a frame around its perimeter and said interchangeable door means including:

first door means having a door frame portion mounting a transparent glass portion, said door frame portion having a flange portion which, when mounted, partially overlaps and is spaced apart from said opening frame to form an air-admitting gap about the periphery of said first door means; and second door means which, when mounted, fits tightly against said opening frame, said second door means having adjustable draft means therethrough.

7. A combination fireplace furnace and cookstove apparatus adapted for insertion as a unit into the front opening of an existing fireplace, comprising:

a firebox portion including first wall means defining first heat exchanging surfaces enclosing a firebox chamber; said portion being adapted for positioning within a fireplace;

a cookstove portion including second wall means extending forwardly from said first wall means and defining second heat exchange surfaces enclosing a stove chamber forming a forward continuation of said firebox chamber, said cookstove portion being adapted to protrude forwardly into a room from the front fireplace opening when said firebox portion is positioned within the fireplace;

baffle means within said firebox chamber and extending forwardly into said stove chamber for directing rising smoke and gases from said firebox chamber forwardly into said stove chamber; and flue means positioned above said firebox portion and said baffle means for exhausting smoke and gases from said apparatus;

said cookstove portion including an exposed, upper heat-exchanging wall defining a cooking surface;

said baffle means including a generally horizontal baffle member spaced below said cooking surface and extending a distance into the cookstove chamber for directing smoke and gases forwardly beneath the baffle member into said cookstove chamber and then rearwardly between the baffle member and said cooking surface toward the flue means to heat said cooking surface.

8. Apparatus according to claim 7 wherein:

said baffle means includes a damper portion within said firebox chamber, said damper portion being pivotable between an open position, for allowing smoke and gases to rise directly from a fire within said firebox chamber to said flue means, and a closed position for directing smoke and gases forwardly into said stove chamber;

said first wall means includes a front upper wall portion sloping upwardly and rearwardly from said cooking surface to said flue means and a rear upper wall portion sloping downwardly and rearwardly from said flue means;

said baffle means being spaced below said cooking surface and front upper wall portion, and having a rear edge in said firebox chamber adjacent the damper portion and spaced forwardly of said rear upper wall portion to provide a pathway for smoke and gases to the flue means when the damper portion is in the open position;

said damper portion being sized and positioned near said rear upper wall portion so that, in said closed position, said damper portion blocks the pathway between said rear upper wall portion and the rear edge of said baffle means to divert the flow of smoke and gases to the cookstove portion.

9. Apparatus according to claim 8 in which said firebox portion is sized so that said firebox walls are spaced inwardly of the fireplace walls to define an airspace having frontal air openings;

said apparatus including multiple upper heat exchange tubes connected to said airspace at the base of said rear upper wall portion and extending upwardly and forwardly through an upper portion of said firebox chamber to discharge openings in said front upper wall portion; and said baffle member including a portion extending between said upper tubes for preventing smoke and hot gases from a fire in said firebox chamber from passing therebetween.

10. Apparatus according to claim 7 wherein said baffle means includes a forward baffle member spaced below said generally horizontal baffle member and protruding rearwardly a distance into said cookstove chamber for deflecting the forwardly-directed smoke and gases upwardly toward said exposed upper wall.

11. A combination fireplace furnace and cookstove apparatus adapted for insertion as a unit into the front opening of an existing fireplace, comprising:

a firebox portion including first wall means defining first heat exchanging surfaces enclosing a firebox chamber; said portion being adapted for positioning within a fireplace and sized so that said firebox walls are spaced inwardly of the fireplace walls to define an airspace having frontal air openings for allowing ambient room air to circulate into contact with the outer surfaces of said first wall means;

barrier means for preventing said room air from escaping up the chimney of the fireplace;

a cookstove portion including second wall means extending forwardly from said first wall means and defining second heat exchange surfaces enclosing a stove chamber forming a forward continuation of said firebox chamber; said cookstove portion being adapted to protrude forwardly into a room from the front fireplace opening when said firebox portion is positioned within the fireplace, and including an exposed horizontal upper wall defining a cooking surface means for transferring heat from said cookstove chamber to objects placed in contact therewith;

baffle means within said firebox chamber and extending into said stove chamber for directing rising smoke and gases from said firebox chamber forwardly into said stove chamber, said baffle means including a generally horizontal baffle member spaced below said upper wall for conducting smoke and gases therebetween to heat said cooking surface means; and multiple heat exchange tubes extending through said firebox chamber from intake openings communicating with the airspace at the rear of said firebox portion to discharge openings communicating with ambient room air at the front of said apparatus, for heating air in said tubes and discharging said air into the room;

said heat exchange tubes including multiple upper tubes extending at an upward inclination through said baffle means to discharge openings rearwardly adjacent said cooking surface means.

12. A combination fireplace furnace and cookstove apparatus adapted for insertion as a unit into the front opening of an existing fireplace, comprising:

a firebox portion including first wall means defining first heat exchanging surfaces enclosing a firebox chamber; said portion being adapted for positioning within a fireplace and sized so that said firebox walls are spaced inwardly of the fireplace walls to define an airspace having frontal air openings for allowing ambient room air to circulate into contact with the outer surfaces of said first wall means;

a cookstove portion including second wall means extending forwardly from said first wall means and defining second heat exchange surfaces enclosing a stove chamber forming a forward continuation of said firebox chamber; said cookstove portion being adapted to protrude forwardly into a room from the front fireplace opening when said firebox portion is positioned within the fireplace, and including a cooking surface means for transferring heat from said cookstove chamber to objects placed in contact therewith;

a jacket encompassing only said firebox portion, leaving said cookstove portion exposed to radiate heat into the room; said jacket being spaced apart from said first wall means to enclose said airspace; and multiple heat exchange tubes extending through an upper portion of said firebox chamber from intake openings communicating with the airspace at the rear of said firebox portion to discharge openings communicating with ambient room air within an airspace portion at an upper frontal position in said jacket and rearwardly of and above said cookstove portion such that heated room air is returned to said room above and rearwardly of said cookstove portion.

13. Apparatus according to claim 12 in which the second wall means defining the cookstove portion include opposite sidewalls, a horizontal top wall, a front wall and a bottom wall enclosing the cookstove chamber, all of said walls having radiant heating surfaces exposed to ambient room air.

* * * * *